United States Patent [19]

Van Den Pol

[11] Patent Number: 4,880,341

[45] Date of Patent: Nov. 14, 1989

[54] SWIVEL PLATFORM FOR A RAIL VEHICLE

[75] Inventor: Aart A. Van Den Pol, Nijkerk, Netherlands

[73] Assignee: De Ark B.V., Nijkerk, Netherlands

[21] Appl. No.: 183,918

[22] Filed: Apr. 20, 1988

[30] Foreign Application Priority Data

Jan. 25, 1988 [NL] Netherlands ..... 8800161

[51] Int. Cl.[4] ..... B65P 1/00

[52] U.S. Cl. ..... 410/1; 105/455; 105/47

[58] Field of Search ..... 104/35, 45, 46, 47; 105/355, 455; 410/1, 2, 3, 44, 52, 66, 67

[56] References Cited

U.S. PATENT DOCUMENTS

| | | | |
|---|---|---|---|
| 1,271,812 | 7/1918 | Wagner | 410/1 |
| 2,165,603 | 7/1939 | Yeats | 410/2 X |
| 2,991,731 | 7/1961 | Clejan | 410/67 |
| 3,143,979 | 8/1964 | Eckersall | 105/455 X |
| 3,336,877 | 8/1967 | O'Donnell | 410/2 X |
| 3,884,158 | 5/1975 | Rumell | 105/455 X |
| 4,425,064 | 1/1984 | Walda et al. | 105/455 X |

FOREIGN PATENT DOCUMENTS

| | | | |
|---|---|---|---|
| 310589 | 8/1933 | Italy | 410/1 |

OTHER PUBLICATIONS

Provisional Specification, British, Viscount de Waresquiel et al., 3/1857.

*Primary Examiner*—Robert B. Reeves
*Assistant Examiner*—Gary C. Hoge
*Attorney, Agent, or Firm*—Arnold, White & Durkee

[57] ABSTRACT

A swivel platform for a rail vehicle is disclosed. The swivel platform is intended for loading a container from a road vehicle onto the rail vehicle and vice versa. The swivel platform comprises a bottom frame which must be fixed to the rail vehicle and a top frame which can swing relative to the bottom frame through an angle of about 45 degrees with respect to the longitudinal axis of the rail vehicle. The top frame is provided with two parallel container guide elements which are connected to each other by means of transverse elements, one of which is provided with a wheel or roller which during the swing movement runs over part of the rail vehicle or over part of the bottom frame. Furthermore each of the parallel container guide elements is also provided with a wheel or roller which during the swing movement runs over part of the rail vehicle or over part of the bottom frame. Provision is made for at least one locking element by means of which the top frame can be locked in the neutral position relative to the bottom frame.

3 Claims, 4 Drawing Sheets

SWIVEL PLATFORM FOR A RAIL VEHICLE

The invention relates to a swivel platform for a rail vehicle, intended for loading a container from a road vehicle onto the rail vehicle and vice versa, comprising a bottom frame which must be fixed to the rail vehicle and a top frame which can swing relative to the bottom frame, via an asymmetrically positioned swing mechanism coupled to both frames, between a neutral position in which the longitudinal axis of the top frame runs approximately parallel to the longitudinal axis of the rail vehicle and a swung-out position in which the longitudinal axis of the top frame forms an angle of about 45 degrees with the longitudinal axis of the rail vehicle, said top frame being provided with two parallel container guide elements which are connected to each other by means of transverse elements, at least one of which is connected to a swing mechanism, while another is provided with a wheel or roller which is positioned centrally between the container guide elements and during the swing movement runs over part of the rail vehicle or over part of the bottom frame and in the swung-out position almost reaches the side edge of the rail vehicle.

Such a swivel platform is described in European patent application No. 0,181,676. This publication describes the way in which the swivel platform can be swung between the two extreme positions, the neutral position and the swung-out position. Use is made here of a conveyor mechanism which is on the road vehicle and is in the first instance intended for transferring the container from the road vehicle onto the rail vehicle, and vice versa. The conveyor mechanism is connected by means of a cable to the top frame of the swivel platform in such a way that the top frame can be swung by pulling on the cable with the conveyor mechanism.

During the swing movement the top frame rests on the one hand on the swing mechanism, which can be, for example, a roller bearing or a ball bearing, and on the other on the wheel or roller which is fastened midway between the container guide elements to one of the transverse elements. When loaded, such great friction forces occur in these two supporting points, in particular near the wheel or roller, that considerable force is needed to swing the top frame between the two end positions. This force is supplied in the known system by the conveyor mechanism on the road vehicle. Such a road vehicle with conveyor mechanism is, however, not always available. Other road vehicles can also be used for the transportation of containers by road. In many cases it is therefore desirable to be able to swing the swivel platform, including a loaded container placed thereon, between the end positions without the help of the above-mentioned conveyor mechanism being necessary on account of the great friction forces.

The above-mentioned great friction forces can also cause considerable wear in the moving parts, in particular in the bearing of the above-mentioned wheel or roller.

The object of the invention is then to indicate the way in which these friction forces can be reduced in such a way that the wear is reduced and a considerably lower force is needed to carry out the swing movement, in particular such a small force that one or two people are capable of making the loaded top frame swing between the two end positions without the aid of power-driven machines.

This object is achieved with a swivel platform of the type referred to in the preamble, in that each of the parallel container guide elements is also provided with a wheel or roller which during the swing movement runs over part of the rail vehicle or over part of the bottom frame, while the wheels or rollers of the container guide elements, viewed in the transverse direction of the top frame, are placed opposite each other and, viewed in the lengthwise direction of the top frame, are placed in such a way that the front wheel of the two in the outward swinging direction passes the side edge of the rail vehicle, and the rear wheel almost reaches the said side edge.

Through the use of further wheels or rollers on the container guide elements, the total weight of the load is uniformly distributed, and each wheel or roller is loaded only with a fraction of the load occurring in the known system. Besides, the sag which can occur in the top frame during loading is greatly reduced, resulting in a further reduction of the friction forces, in particular the asymmetrical forces in the swing mechanism. The total reduction of the friction is such that this leads not only to reduced wear, but also to such reduced power required for carrying out the swing movement that it is possible for one or two people to push a loaded swivel platform by hand from one end position to the other.

A preferred embodiment of a swivel platform according to the invention is characterized in that the parallel guide elements are each provided with a second wheel or roller which, viewed in the transverse direction of the top frame, are placed opposite each other and, viewed in the lengthwise direction of the top frame, are placed in such a way that the front wheel of the two in the direction of the outward swing passes the other side edge of the rail vehicle, and the rear wheel almost reaches the said other side edge. This means that a further support of the load is also achieved at the other side of the asymmetrically positioned swing mechanism, leading to a further distribution of the load and a reduction in the friction force per supporting element. This further facilitates swinging of the top frame, in particular when it is loaded.

Although in some cases the top side of the rail vehicle is itself suitable as a support for the various wheels or rollers, it will in most cases be preferable for the bottom frame to be provided with one or more horizontally positioned parts over which the wheels or rollers fixed to the top frame will run during the swing movement.

Since through use of the invention the swing between the two end positions can be carried out with considerably less friction and thus less force, the problem arises that the swivel platform, loaded with the container, has to be locked in the neutral position to prevent undesirable turning of the platform during rail transportation. Such locking was not necessary in the known swivel platforms, but with the swivel platform according to the invention such locking is desirable.

A preferred embodiment of the swivel platform according to the invention is therefore characterized in that at least one locking element is present, by means of which the top frame can be locked in the neutral position relative to the bottom frame.

In order to facilitate the operation of this locking element, said locking element is preferably provided with a locking pin with bevelled front face which can move in a tubular holder fixed on the bottom frame, between a position in which the front end of the pin blocks a movement of the top frame and a position in which the top frame can pass this front end, the pin being pretensioned in the holder in such a way that, thanks to the bevelled front face, the part of the top face mating with the pin is capable of pushing the pin out of the path of the top frame during the inward swing movement of the top frame.

In order to facilitate unlocking during the outward swing, the pin is secured against turning about the longitudinal axis, and is provided with a triangular recess in which the end of an actuation lever which can rotate through ±90 degrees about the holder engages, in such a way that when the lever moves to the upright position the locking pin is drawn out of the path of the top frame, and in the horizontal position is in this path, the top frame being provided with a part which mates with the lever and during the outward swing, when the lever is placed in the upright position for unlocking, pushes down the lever after at least part of the bottom frame has already passed the pin.

The invention will be explained in greater detail below with reference to the attached figures.

FIG. 1 shows a top view of the swivel platform, comprising a combination of a bottom frame and a top frame, intended for placing on a rail vehicle, the top frame being in the neutral position relative to the bottom frame.

FIG. 2 also shows a top view of the swivel platform, but with the top frame turned to the swung-out position, in which the longitudinal axis of the top frame forms an angle of about 45 degrees with the longitudinal axis of the bottom frame (and thus with the longitudinal axis of the rail vehicle.

Figure 5A:
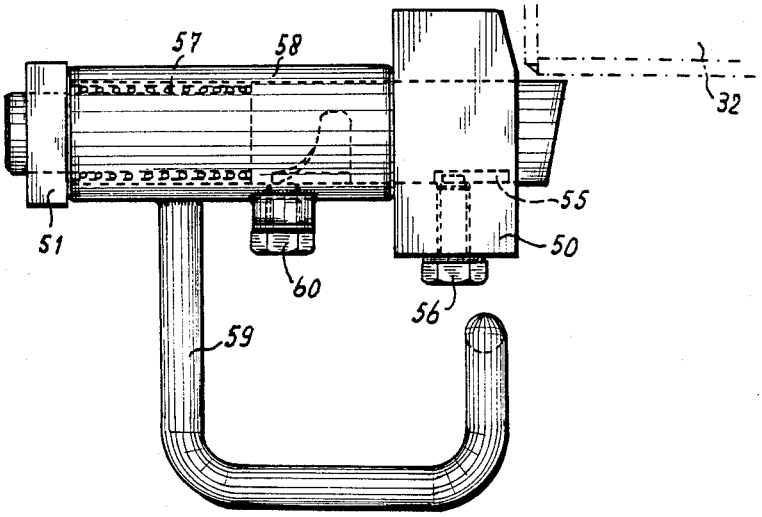

FIGS. 5*a, b, c* show different views of a locking element used according to the invention to lock the swivel platform in the neutral position.

FIG. 6 shows a view of the locking element to explain how it works.

Figure 1:
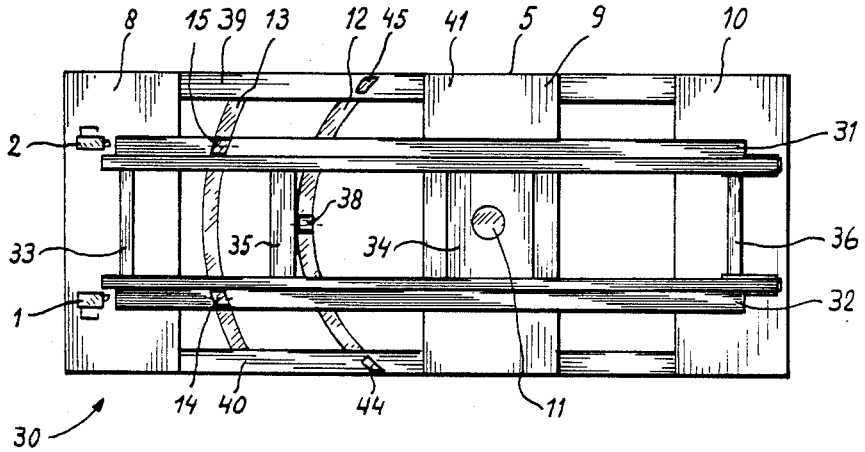

FIG. 1 shows a top view of a swivel platform, comprising a bottom frame and a top frame intended for mounting on the flat top side of a rail vehicle. The bottom frame is provided with two longitudinal runners 39 and 40 connected by means of three transverse runners 8, 9 and 10 which in this embodiment are considerably broader. These longitudinal and transverse runners can be solid plates or bars, hollow tubes, U sections and the like, which are attached to each other by welding or in another suitable manner, in such a way that a by and large flat bottom frame is obtained.

The top frame is provided with two parallel container guide elements 31 and 32 which are connected to each other by means of transverse elements 33, 34, 35 and 36. The transverse element 34 is coupled to a swing mechanism, indicated in its entirety by 11 and also connected to the transverse element 9 of the bottom frame. Such a swing mechanism in the form of a roller bearing, a ball bearing or the like is known per se and will not therefore be discussed any further. This swing mechanism is for ensuring that the top frame can swing from the neutral position illustrated in FIG. 1 to the swung-out position illustrated in FIG. 2, in which swung-out position the longitudinal axis of the top frame forms an angle of about 45 degrees with the longitudinal axis of the bottom frame.

The transverse element 35 of the top frame has mounted on it a wheel 38 which runs over a curved plate, tube or the like, indicated by 12, said element 12 forming part of the bottom frame. Near the ends of this element 12 are stop blocks 44 and 45, which ensure that during the outward swing the top frame stops in the swung-out end position through the wheel 38 being retained by one of these stop blocks 44 or 45.

According to the invention, two further wheels 14 and 15 are fitted in or on the longitudinal guides 31 and 32 of the top frame, at such a point that in the swung-out position one wheel 14 has already passed the side edge of the bottom frame and thus the side edge of the rail vehicle, while the other wheel 15 has almost reached the side edge in question. Like the wheel 38, the wheels 14 and 15 run over a curved part of the bottom frame, indicated by 13. It will be clear that the curved parts 12 and 13 can also be replaced by differently shaped parts of the bottom frame or, if necessary, by parts of the rail vehicle on which the swivel platform is mounted, so long as there is just a curved supporting movement path for the wheels.

Figure 2:
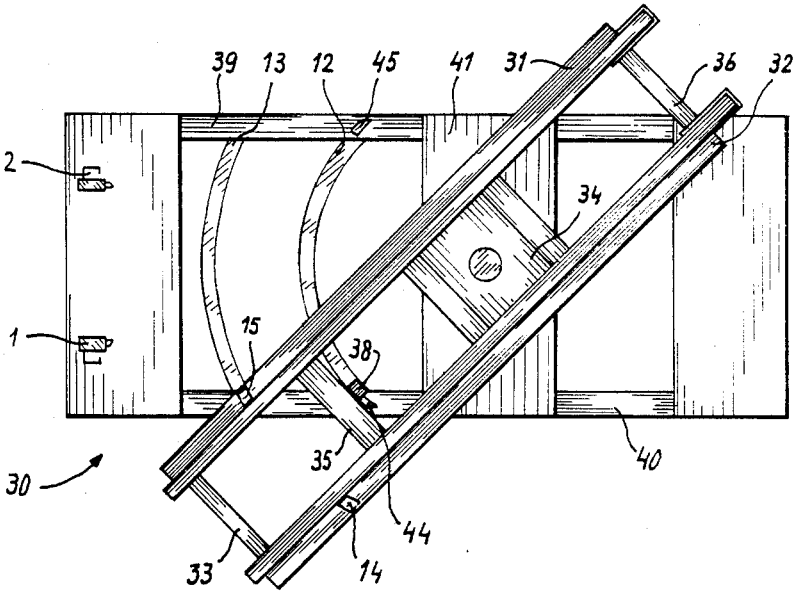

When the top frame swings out in the opposite direction of that shown in FIG. 2, the wheel 15 will pass the side edge, determined by the longitudinal runner 39, and the wheel 14 will almost reach the said side edge.

In the known swivel platform described in the earlier mentioned No. EP-No. 0,181,676 the whole load is supported at only two points during the outward or inward swinging movement, i.e. by the swing mechanism 11 and by the wheel 38. In practice, the swing mechanism can be made fairly large, for example in the form of a ball bearing or roller bearing of relatively large diameter, in which relatively little friction occurs. However, the wheel 38 turns only in two bearings which will be relatively heavily loaded during the swing movement, so that considerable friction will occur. This certainly applies to the slide bearings commonly used because of their simplicity and sturdiness. The result of this is that considerable force is needed to swing the loaded top frame.

The provision of the two additional wheels 14 and 15 now means that the load is distributed over several support points, which leads to a considerable reduction in the friction forces occurring. The weight which has to be supported in the state of the art by one wheel is now taken by two wheels in the swung-out position and even by three wheels once the third wheel starts to run on the curved supporting track 13 during the inward swing or the initial part of an outward swing.

Not only is the load distributed over several support points, but these support points also cover a larger area and are not in line with each other, as is the case with the swivel platform according to the state of the art. Through this surface spread of the support points, the tilting load on the swing mechanism 11, which occurs with the known device, is greatly reduced, and this contributes to a further reduction of friction and resistance forces. The total reduction of the friction and resistance forces is so great that it has been found possible for one or two people without excessive effort to push the loaded top frame by hand from one end position to the other. This is a considerable improvement on the known swivel platform, which must be swung by means of a mechanical conveyor or possibly with other mechanical actions.

The top frame is locked in the neutral position by means of two locking elements 1 and 2, indicated only very schematically in FIGS. 1 and 2. These locking elements will be discussed in detail below with reference to FIGS. 5*a–c*.

Figure 3:
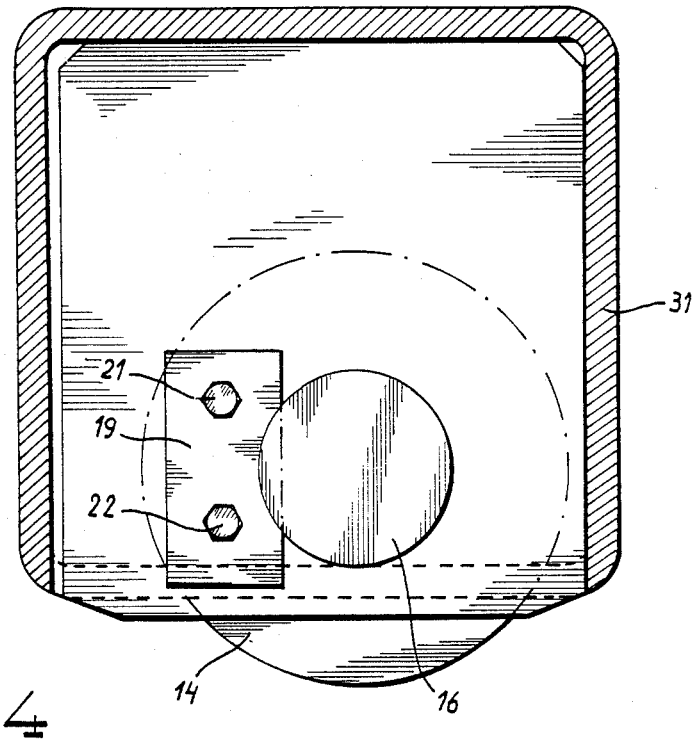
FIG. 3 shows a cross section through one of the longitudinal lines of the top frame at one of the additional supporting rollers.
Figure 4:
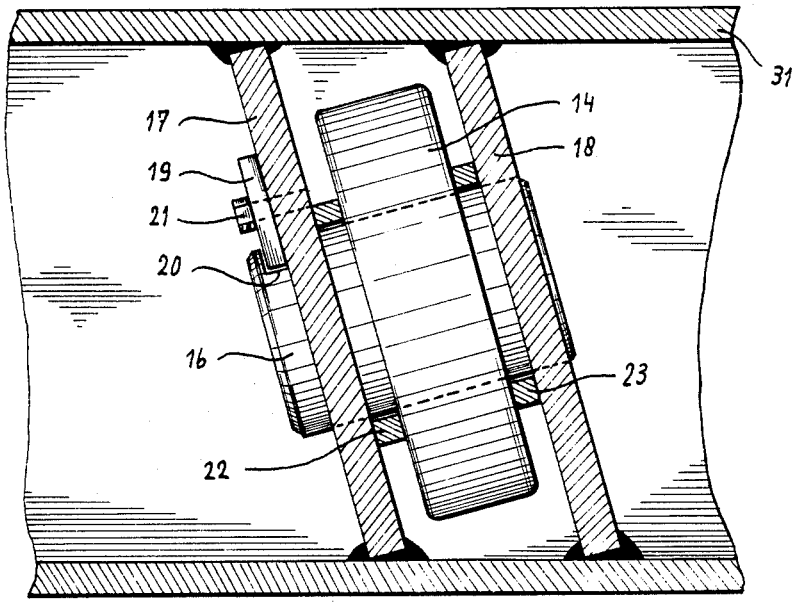
FIG. 4 shows another cross section through the relevant longitudinal lines of the same roller as that shown in FIG. 3.

FIG. 3 shows a partial section in transverse view through one of the longitudinal runners (in this case 32) of the top frame at the point where the wheel is fitted (in this case 14). FIG. 4 shows another view of the runner. The wheel is mounted on a shaft 16 which is supported by two transverse plates 17 and 18, which are disposed by means of welded joints in the hollow (tubular) part of the longitudinal runner 31. These welded joints are indicated schematically without reference numbers in the figures. The plates 17 and 18 are placed at such an angle that the longitudinal axis of the shaft 16 intersects the centre point of the swing mechanism 11. It will be clear that the wheel 14 must run over a circular path whose centre point coincides with the centre point of the swing mechanism 11. The two plates 17 and 18 are provided with openings whose diameter corresponds to the diameter of the shaft 16. Near one of the ends said shaft 16 is provided with a groove 20, into which a locking plate 19 can be inserted, it being possible to fix said locking plate by means of two bolts 21 and 22 or the like to the transverse plate 17. The shaft 16 is thus fixed in a relatively simple, yet sturdy manner. The wheel 16 is confined in the lateral direction between the plates 17 and 18 by means of two rings 22 and 23.

Figure 5B:
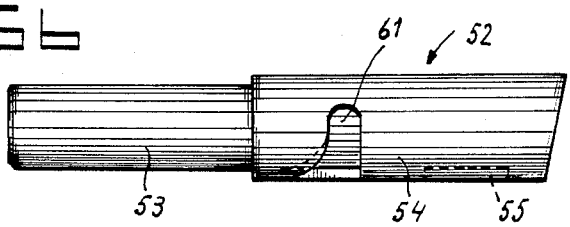
Figure 5C:
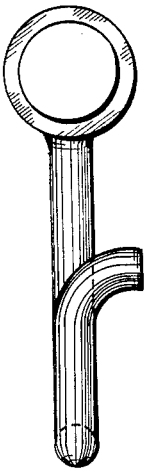

FIGS. 5*a*, 5*b* and 5*c* show three views of the locking structure used according to the invention to lock the top frame in the neutral position. The structure comprises a first block 50 and a second block 51, both provided with a bore whose central axes are in line with each other, and both fixed on the bottom frame of the swivel platform. FIG. 5*b* shows the actual locking pin 52, provided with a left part 53 of relatively smaller cross section, and a right part 54 of relatively greater cross section. The right part 54 contains a key way 55 which runs in the lengthwise direction, and into which the end of a locking pin 56 fits. As shown in FIG. 5*a*, this locking pin is screwed into the block 50 in such a way that the end of the locking pin 56 sticks into the key way 55. When fitted, the locking pin 52 is thus locked against rotation about its longitudinal axis, and the to and fro movement of the locking pin 52 is also limited by the bores in the two blocks 50 and 51. During the fitting, a coil spring 57 is slid onto the thinner part 53 of the locking pin 52, said coil spring in the fitted state resting with one end against the breast between the thinner part 53 and the thicker part 54, and resting with the other end against the block 51. By means of the spring 57, a force is exerted constantly on the locking pin towards the right in the figure.

Around the locking pin is a tube 58, onto which a handle or lever 59 is welded. This tube fits between the blocks 50 and 51 and can be turned round the locking pin 52 by means of the lever 59. The tube 58 has screwed into it an actuation pin 60, which projects in the tube to a triangular key way 61, not yet discussed, in the thicker part 54 of the locking pin 52. It will be clear that rotation of the tube 58 by means of the lever 59 through an angle of approximately 90 degrees from the plane of the drawing upwards leads to a shifting of the locking pin 52 to the left in the figure on account of the mating between the actuation pin 60 and the triangular key way 61. The locking pin 52 is moved here against the force of the coil spring 57.

FIG. 5*a* shows the end of the longitudinal runner 32 of the top frame. In the situation shown, this longitudinal runner 32 is locked by the locking pin 52. However, if the locking pin is moved to the left through turning of the tube 58, the right end of the locking pin 52 will end up outside the path of the longitudinal runner 32, so that the longitudinal runner 32 can be turned.

Figure 5:
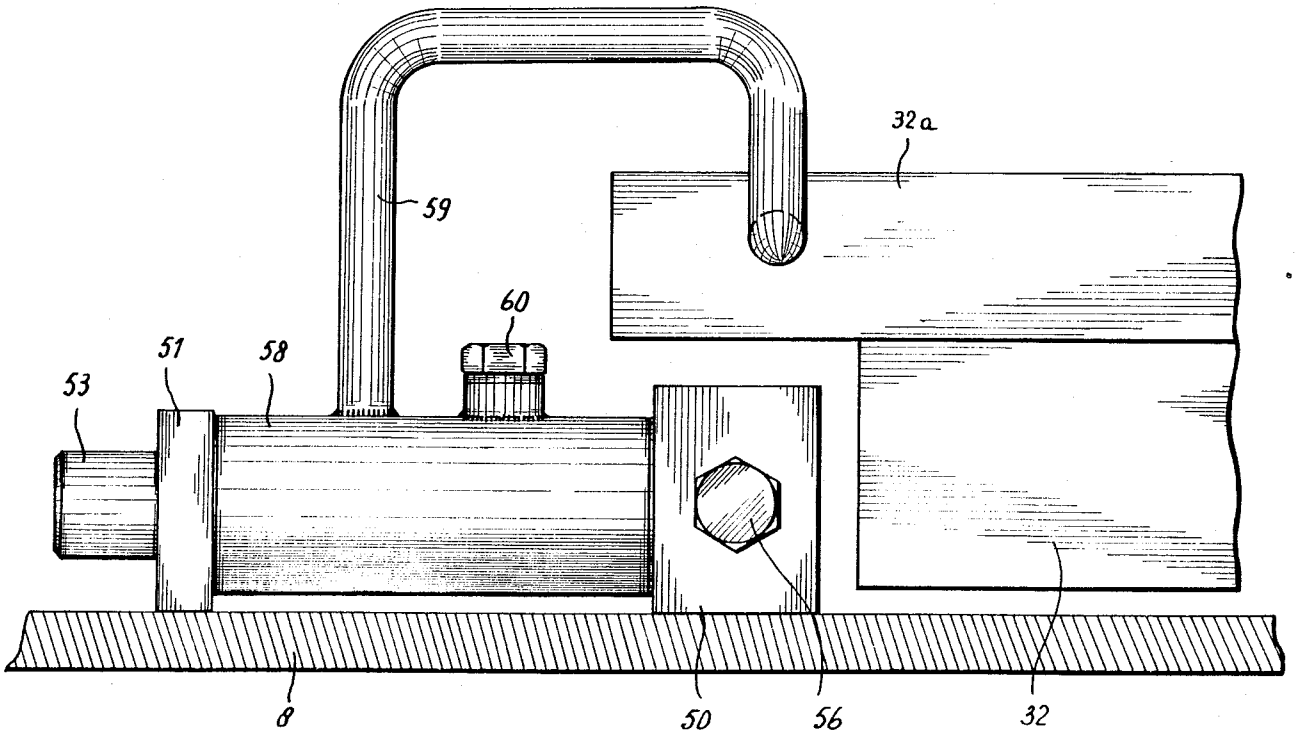

FIGS. 1 and 2 show the place at which the locking elements are mounted on the bottom frame. If we look in particular at element 2, it will be clear that the pin in the situation of FIG. 5 is in such a position that the bottom frame, in particular the longitudinal runner 32 thereof, is locked in the neutral position. The lever is swung down here. If the top frame now has to be turned, the lever is moved upwards, thereby causing the locking pin 52 to be pulled out of the path of the end of the longitudinal runner 32. This situation is illustrated in side view in FIG. 6, in which the locking element can be seen together with a part of the bottom frame and a part of the longitudinal runner 32 of the top frame. As can be seen in FIG. 6, the longitudinal runner has a projecting part 32*a* which is not impeded by the locking pin, but can move over the block 50. As can also be seen in FIG. 6, the locking pin 52 is shifted so far to the left through moving the lever upwards that the bevelled right end of the pin has disappeared completely inside the block 50. If the top frame is now turned, this projecting part 32*a* will go against the end of the lever 59, and will press said lever down, thereby causing the pin 52 to move to the right. The end of the longitudinal runner 32 has then, however, already passed the point of the locking pin 52, and is no longer blocked by it.

For inward swinging of the top frame, the lever can remain in the swung-down position and the locking pin can be held in its blocking position. The blocking end of the locking pin 52 is in fact bevelled in such a way that the slanting end face forms a run-on face for the end of the longitudinal runner 32. Through this bevel, the locking pin 52 is pushed to the left against the force of the spring 57 during the inward swing, so that the inward swing movement is not impeded. Once the end of the longitudinal runner 32 has completely passed the locking pin, the pin 52 jumps back under the influence of the spring 57, thus blocking the longitudinal runner 32.

I claim:

1. A swivel platform for a rail vehicle, intended for loading a container from a road vehicle onto the rail vehicle and vice versa, comprising:

a bottom frame which must be fixed to the rail vehicle and a top frame which can swing relative to the bottom frame, via an asymmetrically positioned swing mechanism coupled to both frames, between a neutral position in which the longitudinal axis of the top frame runs approximately parallel to the longitudinal axis of the rail vehicle and a swung-out position in which the longitudinal axis of the top frame forms an angle of about 45 degrees with the longitudinal axis of the rail vehicle, said top frame being provided with two parallel container guide elements which are connected to each other by means of transverse elements, at least one of which is connected to a swing mechanism, while another is provided with a rolling means which is positioned centrally between the container guide elements and during the swing movement runs over a supporting movement path and in the swung-out position almost reaches a side edge of the rail vehicle, each of the parallel container guide elements also being provided with a rolling means which during the swing movement runs over a supporting movement path, and in which the rolling means of the container guide elements, viewed in the transverse direction of the top frame, are placed opposite each other and, viewed in the lengthwise direction of the top frame, are placed in such a way that front rolling means of the two in the direction of swinging passes the side edge of the rail vehicle, and a rear rolling means almost reaches the said side edge;

provision is made for at least one locking element by means of which the top frame can be locked in the neutral position relative to the bottom frame; and, the locking element is provided with a locking pin with bevelled front face, and which can move in a tubular holder fixed on the bottom frame between a position in which a front end of the pin blocks a movement of the top frame and a position in which the top frame can pass this front end, the pin being pretensioned in the holder in such a way that, because of the bevelled front face, the part of the top frame mating with the pin is capable of pushing the pin out of the path of the top frame during the inward swing movement of the top frame.

2. A swivel platform according to claim 1, wherein:

the pin is secured against turning about the longitudinal axis, and a sleeve within which the pin travels is provided with a triangular recess in which the end of an actuation lever which can rotate through ±90 degrees about the holder engages, in such a way that when the lever is moved to an upright position the locking pin is drawn out of the path of the top frame, and in a horizontal position is in this path, the top frame being provided with a part which mates with the lever and during the outward swing, when the lever is placed in the upright position for unlocking, pushes down the lever after at least part of the bottom frame has already passed the pin.

3. A swivel platform for a rail vehicle, intended for loading a container from a road vehicle onto the rail vehicle and vice versa, comprising:

a bottom frame which must be fixed to the rail vehicle and a top frame which can swing relative to the bottom frame, via an asymmetrically positioned swing mechanism coupled to both frames, between a neutral position in which the longitudinal axis of the top frame runs approximately parallel to the longitudinal axis of the rail vehicle and a swung-out position in which the longitudinal axis of the top frame forms an angle of about 45 degrees with the longitudinal axis of the rail vehicle, said top frame being provided with two parallel container guide elements which are connected to each other by means of transverse elements, at least one of which is connected to a swing mechanism, while another is provided with a rolling means which is positioned centrally between the container guide elements and during the swing movement runs over a supporting movement path and in the swung-out position almost reaches a side edge of the rail vehicle, each of the parallel container guide elements also being provided with a rolling means which during the swing movement runs over a supporting movement path, and in which the rolling means of the container guide elements, viewed in the transverse direction of the top frame, are placed opposite each other and, viewed in the lengthwise direction of the top frame, are placed in such a way that a front rolling means of the two in the direction of swinging passes the side edge of the rail vehicle, and a rear rolling means almost reaches the said side edge;

provision is made for at least one locking element by means of which the top frame can be locked in the neutral position relative to the bottom frame; said locking element comprising a locking pin secured against turning about the longitudinal axis, and a sleeve within which the locking pin travels; said sleeve provided with a triangular recess in which the end of an actuation lever which can rotate through ±90 degrees in such a way that when the lever is moved to an upright position the locking pin is drawn out of the path of the top frame, and in a horizontal position is in this path, the top frame being provided with a part which mates with the lever and during the outward swing, when the lever is placed in the upright position for unlocking, pushes down the lever after at least part of the bottom frame has already passed the pin.

* * * * *

UNITED STATES PATENT AND TRADEMARK OFFICE

CERTIFICATE OF CORRECTION

PATENT NO. : 4,880,341

DATED : November 14, 1989

INVENTOR(S) : Aart A van den Pol

It is certified that error appears in the above—identified patent and that said Letters Patent is hereby corrected as shown below:

Column 7, line 9, before "front" insert -- a -.

Signed and Sealed this

Sixth Day of November, 1990

*Attest:*

HARRY F. MANBECK, JR.

*Attesting Officer*

*Commissioner of Patents and Trademarks*